US006789650B2

(12) United States Patent
Yokotani et al.

(10) Patent No.: US 6,789,650 B2
(45) Date of Patent: Sep. 14, 2004

(54) OIL JET DEVICE FOR PISTON COOLING

(75) Inventors: Hitoshi Yokotani, Saitama (JP); Yoshitsugu Gokan, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 169 days.

(21) Appl. No.: 10/191,073

(22) Filed: Jul. 10, 2002

(65) Prior Publication Data

US 2003/0015375 A1 Jan. 23, 2003

(30) Foreign Application Priority Data

Jul. 17, 2001 (JP) ..... 2001-216520

(51) Int. Cl.[7] ..... F16N 1/00
(52) U.S. Cl. ..... 184/24; 184/7.4; 184/6.5
(58) Field of Search ..... 184/24, 15.2, 6.26, 184/7.4, 11.4, 6.5, 6.8

(56) References Cited

U.S. PATENT DOCUMENTS 5,533,472 A * 7/1996 Sands et al. ..... 123/41.35
5,713,262 A * 2/1998 Sugiyama et al. ..... 92/158
5,917,418 A * 6/1999 Han ..... 340/686.2
6,202,621 B1 * 3/2001 Inumaru et al. ..... 123/196 R
2002/0139322 A1 * 10/2002 Murglin ..... 123/41.35
2003/0041815 A1 * 3/2003 Kawakubo et al. ..... 123/41.35

FOREIGN PATENT DOCUMENTS

JP 60-8408 A * 1/1985
JP 2000-87717 A * 3/2000

* cited by examiner

*Primary Examiner*—David Fenstermacher
(74) *Attorney, Agent, or Firm*—Birch, Stewart, Kolasch & Birch, LLP

(57) ABSTRACT

An oil jet device for piston cooling in which no press-fitting device is required, and the O-ring is prevented from being broken. A filter plug is inserted into an oil passage opening from the crank journal of a crankcase toward the side of the lower portion of the cylinder, and the crank journal is sealed by a plain bearing being abutted against the filter plug. The oil passage is formed by ring-shaped feed paths formed in the ring-shape on the bearing portions on the plain bearing and the crankcase.

20 Claims, 5 Drawing Sheets

OIL JET DEVICE FOR PISTON COOLING

CROSS-REFERENCE TO RELATED APPLICATION

The present application claims priority under 35 U.S.C. §119 to Japanese Patent Application No. 2001-216520, filed on Jul. 17, 2001, the entire contents of which are hereby incorporated by reference.

BACKGROUND OF THE INVENTION

1. Field of the Invention

The present invention relates in general to an oil jet device for piston cooling, and in particular to a mounting structure for a filter plug therefor.

2. Description of Background Art

Oil jet devices for cooling pistons by forcefully injecting lubricating oil to the back side of a piston have been known in the art. An example is depicted in cross section in FIG. 5.

FIG. 5 shows a crankcase 1 and a crank journal 2 rotatably supported by the crankcase 1, a plain bearing 3, a cylinder block 4 connected to the crankcase 1, and cylinder liner 5. A piston 6 capable of sliding movement is provided in the cylinder block, and the piston 6 and the crank journal 2 are connected by a con-rod 7.

The crankcase 1 has an oil passage 1*a*, and an oil jet member 8 is force-fit at a tip thereof.

The oil jet member 8 comprises a larger diameter portion 8*a*, a nozzle 8*b* communicating with the oil passage 1*a*, a smaller diameter portion 8*c* also serving as a filter plug, and an O-ring 9 attached on the smaller diameter portion 8*c*. The oil jet member 8 is mounted in the crankcase by force-fitting the smaller diameter portion 8*c* with the O-ring 9 attached thereon into an upper portion of the oil passage 1*a* from above the crankcase 1, and then abutting a lower end 5*a* of the cylinder liner 5 against an upper portion of the larger diameter portion 8*a*.

In operation, oil is supplied to the engine from the main gallery (not shown) through an oil passage 2*a* in the crank journal 2 and a hole 3*a* formed on the plain bearing 3. From there, oil is injected from the nozzle 8*b* of the oil jet member 8 to the back side of the piston 6 as shown by the arrow O, thereby cooling the piston 6.

A similar oil jet device for piston cooling is disclosed in Japanese Patent Laid-Open No. 2000-87717.

One disadvantage associated with the above-described prior art device is that since the oil jet member 8 must be force-fit into the upper portion of the oil passage 1*a* from above the crankcase 1, a press-fitting device is required for assembly.

A device in which an oil jet member (which does not function as a filter plug) is force-fit from the crank journal side is disclosed in Japanese Patent Laid-Open No. 8408/1985, but it also requires a press-fitting device. In addition, since the smaller diameter portion 8*c* is force-fit into the upper portion of the oil passage 1*a* with the O-ring 9 fit on the smaller diameter portion 8*c* that serves as a filter plug, the O-ring 9 is likely to be broken in the process of force-fitting. Since the O-ring 9 is hidden from view, it cannot be checked visually, and it is impossible to tell whether the O-ring has been broken during force-fitting of the smaller diameter portion 8*c* into the oil passage 1*a*. Thus, reliability of the device may be impaired.

SUMMARY AND OBJECTS OF THE INVENTION

It is an object of the present invention to solve the aforementioned problems, and to provide an oil jet device for piston cooling in which a press-fitting device is not required, and breakage of the O-ring can be prevented.

In order to achieve the aforementioned objects, the present invention includes a device for injecting lubricating oil toward the back side of a piston comprising an oil passage opening through a crank case from a crank journal side to a side of a lower portion of the cylinder and a filter plug inserted into the oil passage from the crank journal side. The crank journal side of the oil passage is partially sealed by a plain bearing that abuts against the filter plug.

Further, the present invention includes a feed path for feeding oil to the oil passage formed by the plain bearing and the crankcase.

Additionally, the present invention includes a ring-shaped feed path for feeding oil to the oil passage formed at the bearing portion of the crankcase.

As described above, the oil jet device of the present invention injects lubricating oil toward the back side of the piston comprising an oil passage opening through the crank case from the crank journal side to the side of the lower portion of the cylinder, and a filter plug inserted into the oil passage from the crank journal side, wherein the crank journal side of the oil passage is partially sealed by a plain bearing that abuts against the filter plug. As a result, the filter plug is prevented from becoming detached because it abuts the plain bearing. Since the filter plug is inserted into the oil passage from the crank journal side and is prevented from detaching by the plain bearing, it is not necessary to employ a press-fitting device as was required in the prior art.

In addition, since the filter plug may simply be inserted into the oil passage without force-fitting, even when an O-ring is attached on the filter plug, the O-ring is very rarely broken in the course of inserting the filter plug. Consequently, reliability of the device is improved. Since the filter plug is merely inserted into the oil passage, when problems arise such as clogging in the filter plug, maintenance can be performed easily. This is accomplished simply by removing the plain bearing and detaching the filter plug. Construction of the oil passage is also vastly simplified, because in the present invention, the feed path for feeding oil into the oil passage for piston cooling is formed by the plain bearing and the crankcase.

Finally, since the feed path is formed into a ring shape at the bearing portion of the crankcase, large quantities of oil for piston cooling can be fed smoothly in comparison to prior art devices, in which oil is fed to the oil passage through the oil passage 2*a* in the crank journal 2. Therefore, piston cooling efficiently is greatly improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
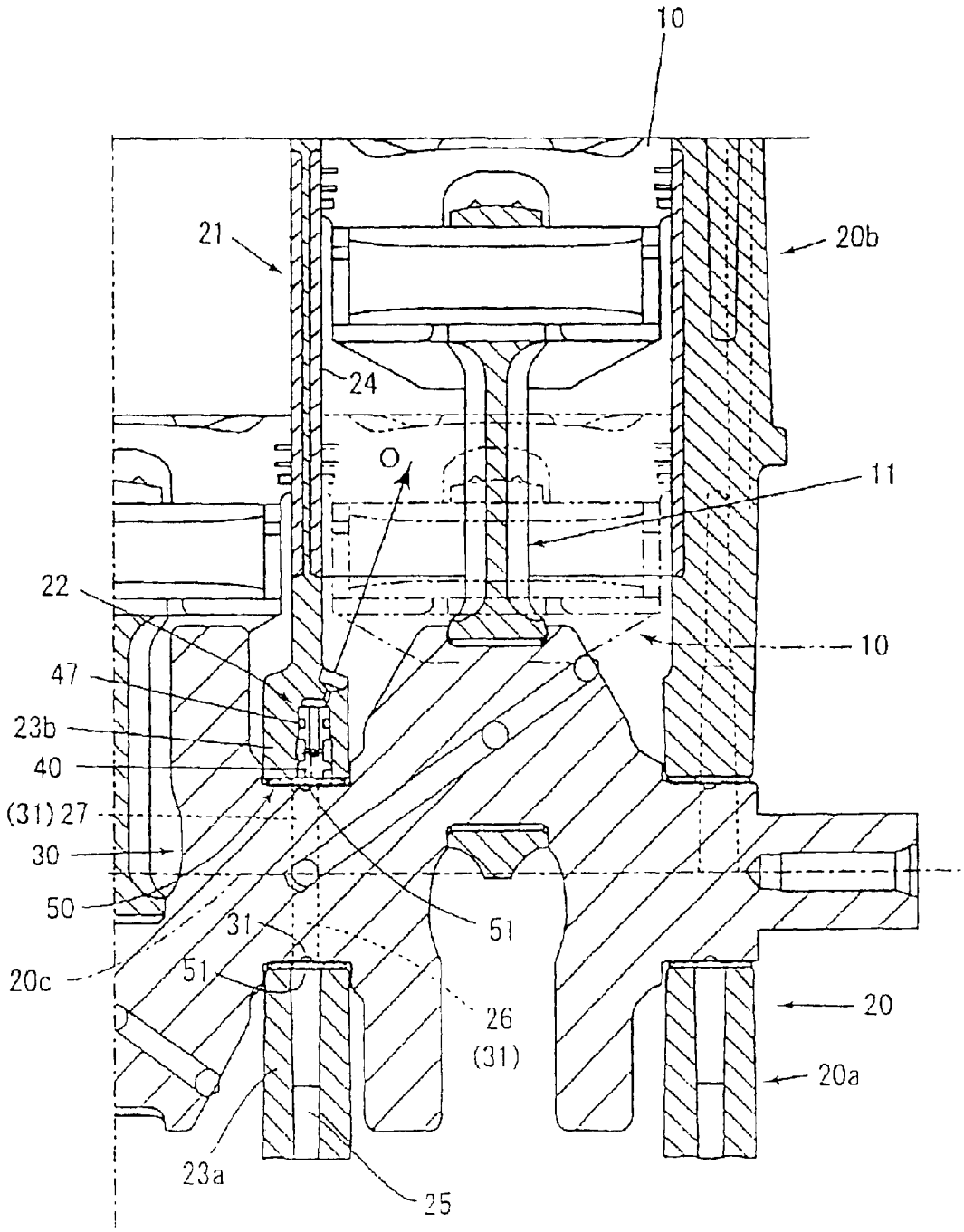
FIG. 1 is a cross sectional view showing an embodiment of the oil jet device for piston cooling according to the present invention.

Referring now to the attached drawings and to FIG. 1 in particular, an embodiment of the present invention will be described below.

As shown in the figures, the oil jet device for piston cooling is a device for injecting lubricating oil (see arrow O) toward the back side of a piston 10. The device includes an oil passage 22 opening through a crank case 20 from a crank journal 30 side to a side of the lower portion of a cylinder 21 (see the arrow O), and a filter plug 40 inserted into the oil passage 22 from the crank journal 30 side, wherein the crank journal 30 side of the oil passage 22 is partially sealed by a plain bearing 50 that abuts against the filter plug 40.

The crankcase 20 is formed by connecting a lower case 20*a* and an upper case 20*b* along a parting plane 20*c* so as to join with each other. The crank journal 30 is rotatably supported by bearing portions 23*a*, 23*b* formed integrally with the lower case 20*a* and the upper case 20*b*, respectively, so as to oppose each other via a plain bearing 50.

The cylinder 21 is formed on the upper case 20*b*, and the piston 10 is slidably disposed in the cylinder 21. The piston 10 and the crank journal 30 are connected by a con-rod 11. A cylinder liner 24 forms the inner surface of the cylinder 21.

Figure 2A:
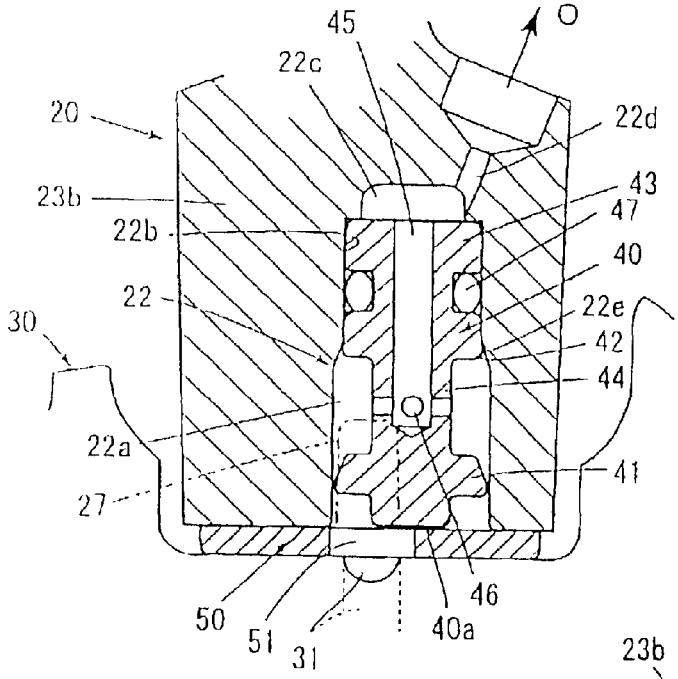
FIG. 2(*a*) is a partial enlarged view of FIG. 1, FIG. 2(*b*) is a right cross sectional view of FIG. 2(*a*), and FIG. 2(*c*) is a partially omitted bottom view of FIG. 2(*b*)
Figure 2B:
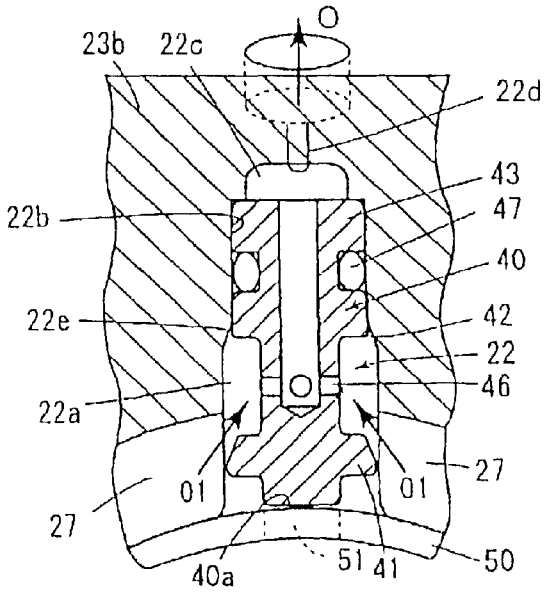
Figure 2C:
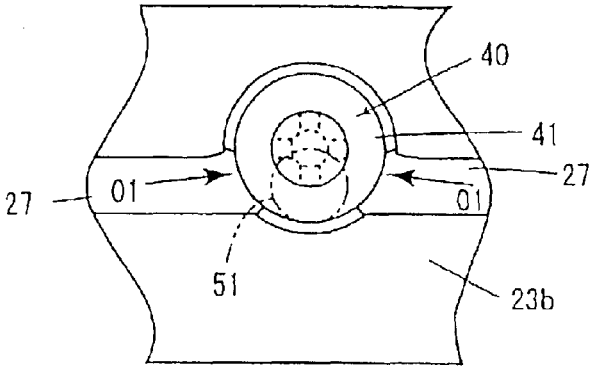
Figure 4B:
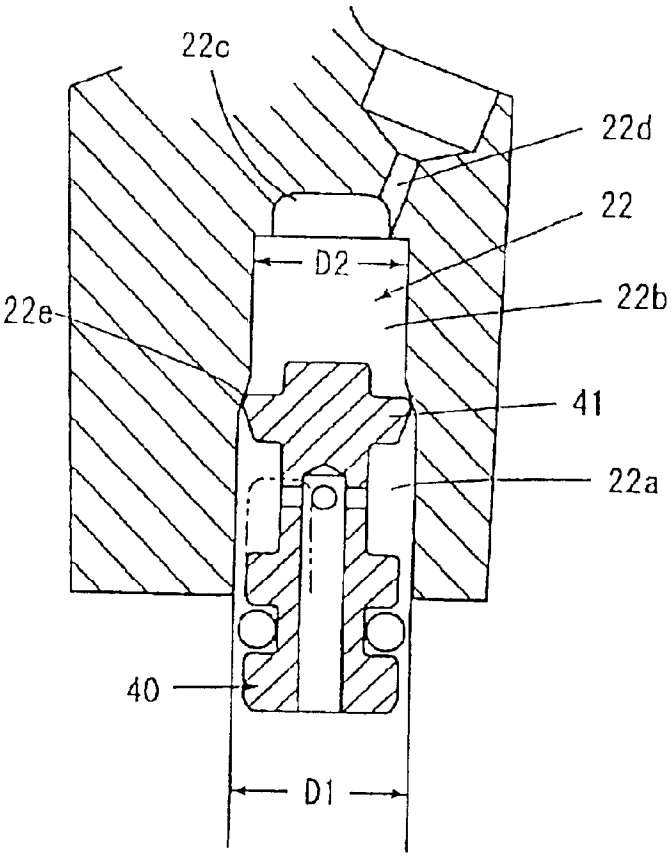
FIG. 4(*a*) illustrates the process of inserting a filter plug 40 into an oil passage 22, and FIG. 4(*b*) illustrates an attempt to insert the filter plug upside down.
Figure 4A:
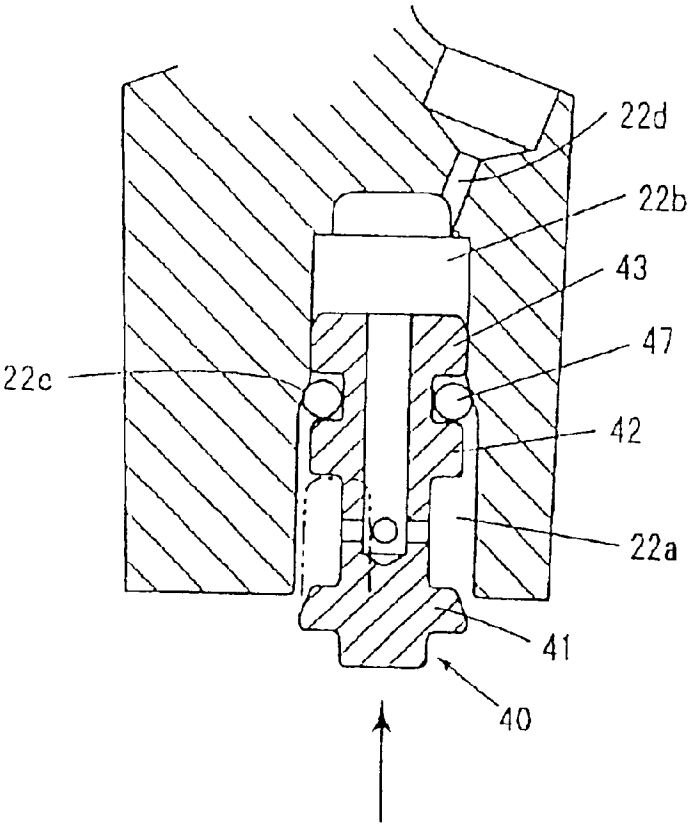
Figure 5:
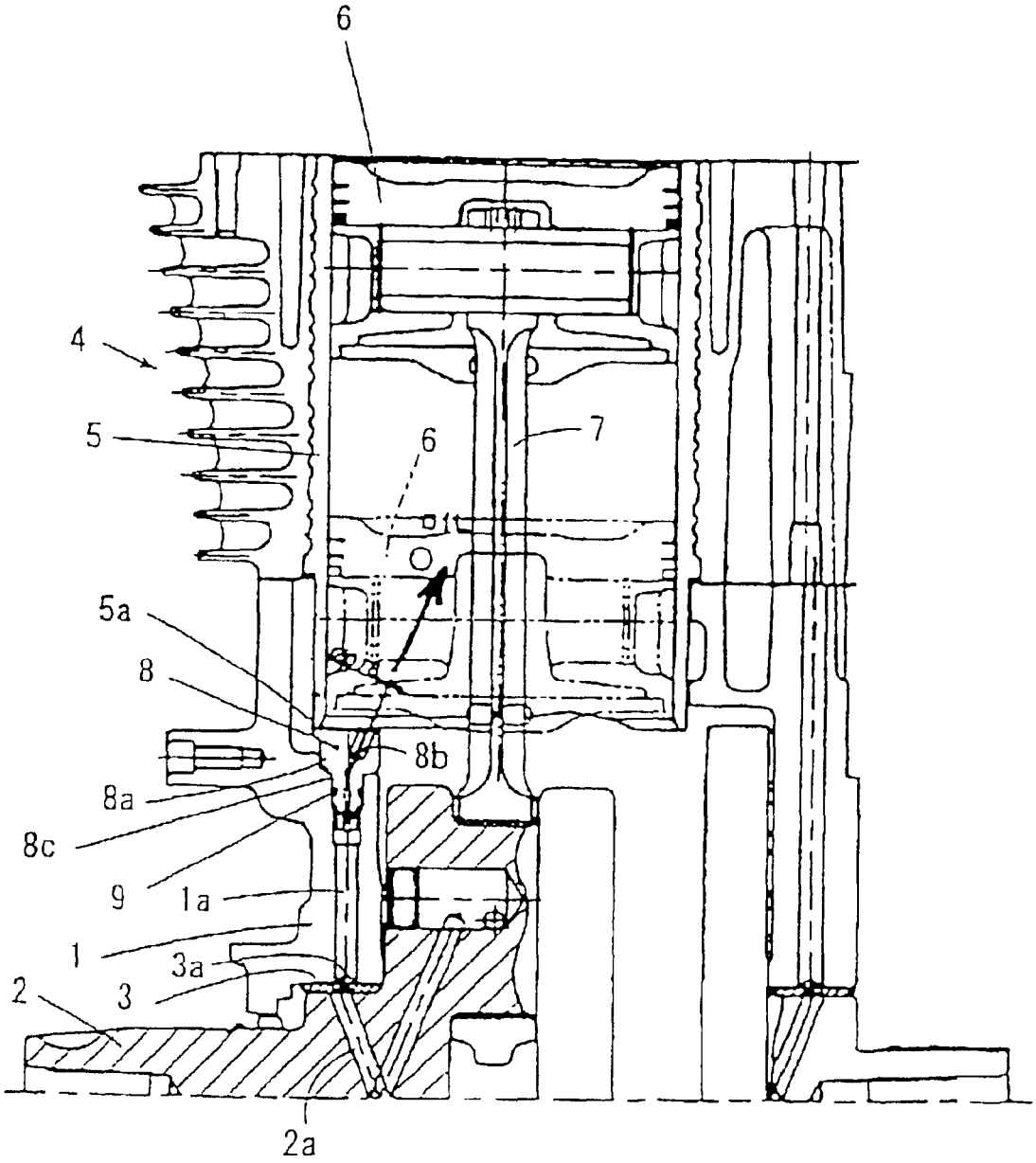
FIG. 5 PRIOR ART
FIG. 5 is an explanatory drawing of the prior art.

The oil passage 22 is formed in the bearing portion 23*b* of the upper 20*b* as shown in FIGS. 2 and FIG. 4(*b*). The oil passage includes a larger diameter portion 22*a*, a first smaller diameter portion 22*b* continuing therefrom, a second smaller diameter portion 22*c* continuing therefrom, and a nozzle portion 22*d* continuing therefrom.

The larger diameter portion 22*a*, the first smaller diameter portion 22*b*, and the second smaller diameter portion 22*c* are formed by drilling from the lower side in FIG. 2(*a*), and the nozzle portion 22*d* can be formed by drilling obliquely from above in the same figure.

The nozzle portion 22*d* is oriented to extend toward the back side of the piston 10, so that lubricating oil is injected toward the back side of the piston 10 as shown by the arrow O in FIG. 1.

Figure 3A:
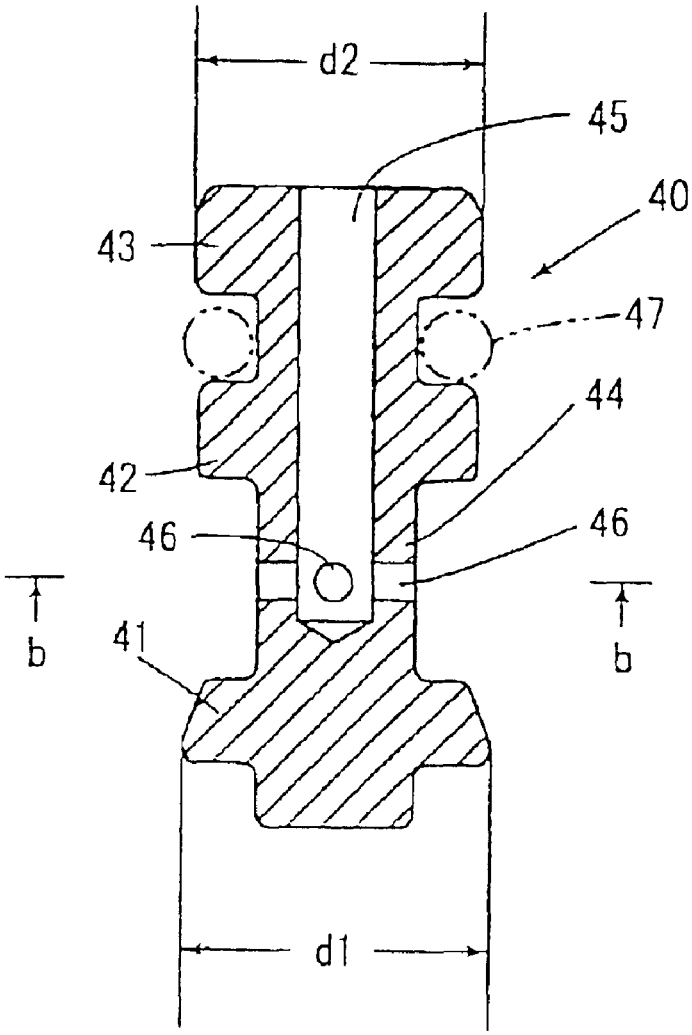
FIG. 3(*a*) is a front view of a filter plug, and FIG. 3(*b*) is a cross sectional view taken along line b—b in FIG. 3(*a*)
Figure 3B:
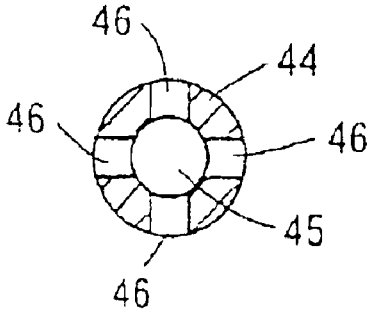

As shown in FIG. 3, the filter plug 40 includes a smaller diameter portion 44, a first flange portion 41, a second flange portion 42, and the third flange portion 43 integrally formed with the smaller diameter portion 44.

The smaller diameter portion 44 is formed with an internal oil passage 45 from the tip to a position between the first and second flange portions 41, 42. The small diameter portion 44 includes four orifices 46, each having a cross shape when viewed from the bottom of the position between the first and second flange portions 41, 42 so as to communicate with the internal oil conduit 45 as shown in FIG. 3(*b*). The diameter of the orifice 46 is smaller than that of the oil conduit 45. For example, the diameter of the orifice 46 is constructed to be approximately 1 mm when the diameter of the internal oil conduit 45 is about 2 mm.

As shown in FIGS. 3(*a*) and 4(*b*), the outer diameter d1 of the first flange portion 41 is slightly smaller than the inner diameter D1 of the larger diameter portion 22*a* of the oil passage 22. The outer diameter d2 of the second flange portion 42 and the third flange portion 43 is slightly smaller than the inner diameter D2 of the first smaller diameter portion 22*b* of the oil passage 22. Further, the outer diameter d1 of the first flange portion 41 is larger than the inner diameter D2 of the first smaller diameter portion 22*b* of the oil passage 22.

As shown in FIGS. 2(*a*), 2(*b*), and FIG. 4(*a*), the filter plug 40 is inserted into the oil passage 22 from the crank journal 30 side. The O-ring 47 is attached between the second flange portion 42 and the third flange portion 43.

As shown in FIGS. 2(*b*) and 4(*b*), the outer diameter of the O-ring 47 in the free state is substantially equal to the inner diameter D1 of the larger diameter portion 22*a* of the oil passage 22, and is larger than the inner diameter D2 of the first smaller diameter portion 22*b* of the oil passage 22. A slightly tapered shoulder portion 22*e* is provided between the larger diameter portion 22*a* and the first smaller diameter portion 22*b* in the oil passage 22. The tapered shoulder portion 22*e* gradually compresses the O-ring 47 when it reaches the tapered shoulder portion 22*e* during insertion of the filter plug 40 into the oil passage 22. See FIG. 4(*a*). When the O-ring reaches the first smaller diameter portion 22*b* of the oil passage 22, it is compressed into an oval shape by the internal wall surface thereof and the outer surface of the filter plug 40, as shown in cross section in FIG. 2(*a*). When the filter plug 40 is completely inserted into the oil passage 22, the flow of oil from the larger diameter portion 22*a* of the oil passage 22 directly to the second smaller diameter portion 22*c* is blocked by the O-ring 47, and thus is only able to pass into the orifice 46.

As described above, the shoulder portion 22*e* of the oil passage 22 between the larger diameter portion 22*a* and the first smaller diameter portion 22*b* is formed into the gentle tapered shape, and the O-ring 47 is gradually compressed by the tapered shoulder portion 22*e* when the filter plug 40 is inserted into the oil passage 22. Thus, there is minimal risk that the O-ring 47 will break during insertion of the filter plug 40.

As also described above, the outer diameter d1 of the first flange portion 41 of the filter plug 40 is larger than the inner diameter D2 of the first smaller diameter portion 22*b* of the oil passage 22, as shown in FIG. 4(*b*). Thus, when trying to insert the filter plug 40 upside down, the first flange portion 41 abuts against the tapered shoulder portion 22*e* of the oil passage 22. As a result, the filter plug 40 cannot be inserted upside down, thereby preventing improper assembly of the oil jet device.

The plain bearing 50 is a bearing comprising two halves divided along the same surface as the parting surface 20*c* of the crankcase 20, and each half comprises a hole 51 for passing oil.

As shown in FIGS. 1 and 2(*a*), the plain bearing 50 is interposed between the crank journal 30 and the bearing portions 23*a*, 23*b* of the crankcase 20. In the interposed state, the oil passage 22 is partially (except for the portion of the hole 51) sealed on the crank journal 30 side, and is capable of abutting against one end 40*a* of the filter plug 40.

Therefore, during engine assembly (at least when the crankcase 20 is assembled and the plain bearing 50 is provided), the filter plug 40 is cannot become detached from the oil passage 22.

As shown in FIG. 1, one of the bearing portions 23*a* of the crankcase 20 is formed with an oil passage 25 in communication with the main gallery (not shown) of the crankcase 20 to which lubrication oil is pumped by an oil pump (not shown). A half-ring-shaped oil passage 26 continuing into the oil passage 25 is disposed in the groove shape along the bearing surface (i.e., the surface facing toward the outer peripheral surface of the plain bearing 50).

A similarly shaped oil passage 27 is provided in the other bearing portion 23*b* and continues into the oil passage 26 at the end thereof. The upper portion of the oil passage 27 communicates with the larger diameter portion 22*a* of the oil passage 22 as shown in FIGS. 2(*a*) and 2(*b*). A ring-shaped oil passage 31 is formed on the surface facing the inner peripheral surface of the plain bearing 50 of the crank journal 30. The oil passage 31 communicates with the larger diameter portion 22*a* of the oil passage 22 via upper and lower holes 51, 51 of the plain bearing 50 and the oil passage 25 of the bearing portion 23*a*.

Therefore, when the engine is operating, oil pumped by the oil pump (not shown) is pumped from the main gallery (not shown) through the oil passage 25 of the bearing portion 23*a*, the lower hole 51 of the plain bearing 50, the ring-shaped oil passage 31 of the crank journal 30, and the upper hole 51 of the plain bearing 50 into the larger diameter portion 22*a* of the oil passage 22.

Simultaneously, oil from the oil passage 25 of the bearing portion 23*a* is pumped through the oil passage 26 of the bearing portion 23*a* and the oil passage 27 of the other bearing portion 23*b* to the larger diameter portion 22*a* of the oil passage 22 as shown by the arrows 01 in FIGS. 2(*b*) and 2(*c*).

Oil pumped into the larger diameter portion 22*a* of the oil passage 22 is injected from the nozzle portion 22*d* of the oil passage 22 through the orifice 46 of the filter plug 40, the internal oil conduit 45, and the second smaller diameter portion 22*c* of the oil passage 22 toward the back side of the piston 10 as shown by the arrow O to cool the piston 10 down.

As is clear from the description above, in this embodiment, the feed paths (25, 51, 31, 51) for feeding oil to the oil passage 22 are formed by the plain bearing 50 and the crankcase 20. Simultaneously, the feed path for feeding oil to the oil passage 22 is formed by the ring-shaped feed paths (26, 27) formed in the ring shape on the bearing portions 23*a*, 23*b* of the plain bearing 50 and the crankcase 20.

With the oil jet device for piston cooling as described above, the following effects:

(a) Since the device for injecting lubricating oil toward the back side of the piston 10 includes an oil passage 22 opening through the crank case 20 from the crank journal 30 side to the side of the lower portion of the cylinder 21, and a filter plug 40 inserted into the oil passage 22 from the crank journal 30 side, and the crank journal 30 side of the oil passage 22 is partially sealed by the plain bearing 50 that abuts against the filter plug 40, the filter plug 40 cannot be detached. Since the filter plug 40 is inserted into the oil passage 22 from the crank journal 30 side and is prevented from being detached by the plain bearing 50, a press-fitting device, which is required in prior art devices, is not necessary.

Since the filter plug 40 is simply inserted into the oil passage 22 without force-fitting, even when the O-ring 47 is attached on the filter plug 40, there is little likelihood that the O-ring 47 will be broken during insertion of the filter plug 40. Accordingly, reliability of the device is improved.

As is described above, the shoulder portion 22*e* of the oil passage 22 is slightly tapered between the larger diameter portion 22*a* and the first smaller diameter portion 22*b*, and the O-ring 47 is compressed gradually by the tapered shoulder portion 22*e* when the filter plug 40 is inserted into the oil passage 22. Thus, the is little likelihood that the O-ring 47 will break during insertion of the filter plug 40.

In addition, since the filter plug 40 is simply inserted into the oil passage 22 and blocked from detaching the plain bearing 50, when clogging of the filter plug 40 occurs, maintenance can be performed easily by dividing the crank case 20 into an upper half and a lower half, removing the plain bearing 50, and detaching the filter plug 40.

(b) Since a feed path for feeding oil into the oil passage 22 is formed by the plain bearing 50 and the crankcase 20, when a part of oil to be fed to the crank journal 30 is used for piston cooling, construction of the passage is simplified.

(c) Since the feed path for feeding oil to the oil passage 22 is formed by the plain bearing 50 and feed paths 26, 27 formed into ring shapes at the bearing portion of the crankcase 20, large quantities of oil for piston cooling can be fed smoothly in comparison to the previously described prior art device, in which oil is fed to the oil passage through the oil passage 2*a* in the crank journal 2. As a result, piston cooling efficiently is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil jet device for piston cooling for injecting lubricating oil toward a back side of the piston, comprising:

an oil passage opening through the crank case from the crank journal side to the side of the lower portion of the cylinder; and a filter plug inserted into the oil passage from the crank journal side, wherein the crank journal side of the oil passage is partially sealed by a plain bearing that abuts against the filter plug, wherein the filter plug is formed with an orifice on a side thereof, the orifice for enabling the lubricating oil to flow into and through the filter plug to a nozzle of the oil jet device.

2. The oil jet device for piston cooling according to claim 1, further comprising a feed path for feeding oil into the oil passage formed by the plain bearing and the crankcase.

3. The oil jet device for piston cooling according to claim 1, further comprising a ring-shaped feed path formed at the bearing portion of the crankcase for feeding oil into the oil passage.

4. The oil jet device for piston cooling according to claim 1, wherein the filter plug abuts the plain bearing, thereby preventing detachment of the filter plug.

5. The oil jet device for piston cooling according to claim 1, wherein the oil passage includes a first portion with a first diameter, a tapered portion continuing from the first portion, a second portion with a second diameter continuing from the tapered portion, and a third portion with a third diameter continuing from the second portion, wherein the third diameter is smaller than the second diameter, and the second diameter is smaller than the first diameter.

6. The oil jet device for piston cooling according to claim 5, wherein the filter plug includes a first flange portion with a diameter larger than the second diameter of the second portion of the oil passage, for preventing the filter plug from being inserted incorrectly into the oil passage.

7. The oil jet device for piston cooling according to claim 5, wherein the filter plug includes a second flange portion and a third portion, with a space therebetween for containing an O-ring, the O-ring having a diameter substantially equal to the first diameter of the first portion of the oil passage, the O-ring being gradually compressed by the tapered shoulder portion when being inserted into the third portion of the oil passage.

8. The oil jet device for piston cooling according to claim 5, wherein the filter plug includes a small diameter portion between the first flange portion and the second flange portion, the small diameter portion being formed with an internal oil conduit and said orifice for communicating with the internal oil conduit and the first portion of the oil passage.

9. An oil jet device for piston cooling for injecting lubricating oil toward a back side of the piston, comprising:

an oil passage opening through the crank case from the crank journal side to the side of the lower portion of the cylinder; and a filter plug inserted into the oil passage from the crank journal side, the filter plug having a first flange portion with an outer diameter larger than an inner diameter of an interior portion of the oil passage for preventing the filter from being inserted incorrectly, wherein the crank journal side of the oil passage is partially sealed by a plain bearing that abuts against the filter plug.

10. The oil jet device for piston cooling according to claim 9, further comprising a feed path for feeding oil into the oil passage formed by the plain bearing and the crankcase.

11. The oil jet device for piston cooling according to claim 9, further comprising a ring-shaped feed path formed at the bearing portion of the crankcase for feeding oil into the oil passage.

12. The oil jet device for piston cooling according to claim 9, wherein the filter plug abuts the plain bearing, thereby preventing detachment of the filter plug.

13. The oil jet device for piston cooling according to claim 9, wherein the oil passage includes a first portion with a first diameter, a tapered portion continuing from the first portion, a second portion with a second diameter continuing from the tapered portion, and a third portion with a third diameter continuing from the second portion, wherein the third diameter is smaller than the second diameter, and the second diameter is smaller than the first diameter.

14. The oil jet device for piston cooling according to claim 13, wherein the diameter of the first flange portion of the filter plug is larger than the second diameter of the second portion of the oil passage, thus preventing the filter plug from being inserted incorrectly into the oil passage.

15. The oil jet device for piston cooling according to claim 13, wherein the filter plug includes a second flange portion and a third portion, with a space therebetween for containing an O-ring, the O-ring having a diameter substantially equal to the first diameter of the first portion of the oil passage, the O-ring being gradually compressed by the tapered shoulder portion when being inserted into the third portion of the oil passage.

16. The oil jet device for piston cooling according to claim 13, wherein the filter plug includes a small diameter portion between the first flange portion and the second flange portion, the small diameter portion being formed with an internal oil conduit and four orifices communicating with the internal oil conduit and the first portion of the oil passage.

17. The oil jet device for piston cooling according to claim 1, wherein an end surface of the filter plug abutting against the plain bearing is a closed.

18. The oil jet device for piston cooling according to claim 9, wherein an end surface of the filter plug abutting against the plain bearing is a closed.

19. The oil jet device for piston cooling according to claim 1, wherein a hole forming the nozzle is formed in the crankcase.

20. The oil jet device for piston cooling according to claim 9, wherein a hole forming a nozzle is formed in the crankcase.

* * * * *